US005731538A

United States Patent [19]

O'Brien et al.

[11] Patent Number: 5,731,538

[45] Date of Patent: Mar. 24, 1998

[54] METHOD AND SYSTEM FOR MAKING INTEGRATED SOLID-STATE FIRE-SETS AND DETONATORS

[75] Inventors: Dennis W. O'Brien, Livermore; Robert L. Druce, Union City; Gary W. Johnson, Livermore; George E. Vogtlin, Fremont; Troy W. Barbee, Jr., Palo Alto; Ronald S. Lee, Livermore, all of Calif.

[73] Assignee: The Regents of the University of California, Oakland, Calif.

[21] Appl. No.: 816,952

[22] Filed: Feb. 19, 1997

[51] Int. Cl.[6] ..... F42B 3/12; F42C 19/12

[52] U.S. Cl. ..... 102/202.5; 102/202.7; 102/206

[58] Field of Search ..... 102/202.7, 202.5, 102/206, 200

[56] References Cited

U.S. PATENT DOCUMENTS

| | | | |
|---|---|---|---|
| H1366 | 11/1994 | Bickes, Jr. et al. | 102/202.5 |
| 3,166,689 | 1/1965 | Buntenbach | 102/202.7 |
| 4,602,565 | 7/1986 | MacDonald et al. | 102/202.7 |
| 4,852,493 | 8/1989 | Boberg et al. | 102/202.7 |
| 4,928,595 | 5/1990 | Weingart | 102/202.7 |
| 5,173,570 | 12/1992 | Braun | 102/202.7 |
| 5,249,095 | 9/1993 | Hunter | 102/202.5 |
| 5,291,828 | 3/1994 | Nerheim et al. | 102/202.7 |
| 5,370,053 | 12/1994 | Williams et al. | 102/202.5 |
| 5,370,054 | 12/1994 | Reams et al. | 102/202.7 |
| 5,414,588 | 5/1995 | Barbee, Jr. et al. | 361/304 |
| 5,431,104 | 7/1995 | Barker | 102/202.7 |
| 5,486,277 | 1/1996 | Barbee, Jr. et al. | 204/192.15 |
| 5,488,908 | 2/1996 | Gilpin et al. | 102/202.7 |

*Primary Examiner*—Michael J. Carone
*Assistant Examiner*—Theresa M. Wesson
*Attorney, Agent, or Firm*—Henry P. Sartorio; Richard B. Main

[57] ABSTRACT

A slapper detonator comprises a solid-state high-voltage capacitor, a low-jitter dielectric breakdown switch and trigger circuitry, a detonator transmission line, an exploding foil bridge, and a flier material. All these components are fabricated in a single solid-state device using thin film deposition techniques.

6 Claims, 4 Drawing Sheets

METHOD AND SYSTEM FOR MAKING INTEGRATED SOLID-STATE FIRE-SETS AND DETONATORS

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to explosives and more particularly to compact, integrated, solid-state slapper detonator systems.

2. Description of Related Art

Slapper detonators make industrial high explosives and military weapons that use high explosives much safer to inventory because the main charges can be made from explosive compounds. The accidental ground impact of such high explosives from being dropped from high altitude isn't even enough to detonate such insensitive compounds.

The slapper detonator uses a very small cache of highly sensitive high explosive that is pocketed out of harm's way until the unit is deliberately armed and made ready to fire. In order to arm the detonator, the pellet of sensitive high explosive is moved into a position where it can act as a detonator for the bulk of high explosive. An electrical discharge is used to vaporize bridgefoil covered by a flier material layer. An expanding plasma from the bursting bridgefoil propels fragments of the flier material at high velocity toward the exposed high-explosive pellet. When the flying fragments hit, the high sensitivity high explosive detonates and that, in turn detonates the low sensitivity high explosive.

The electrical discharges used in slapper detonators usually involve moderately high voltages and currents delivered in a single short-duration pulse, e.g., as can be obtained from shorting a charged capacitor. The current and voltage profiles must meet certain criteria and dwell for a sufficient time in order to properly launch the flier material. Such constraints are fortuitous, because they further reduce the possibility of an accidental detonation.

U.S. No. Pat. 4,852,493 issued Aug. 1, 1989, to Boberg, et al., describes a ferrite core coupled slapper detonator and method. An earlier slapper detonator is described by John R. Stroud in the Lawrence Livermore Laboratory document UCRL-77639 dated Feb. 27, 1976, titled "A New Kind of Detonator —The Slapper". These slapper detonators operated by exploding a thin metal foil that drove a dielectric film across a gap to impact on a high-density explosive. The thin conductive metal foil was explosively vaporized with the precise electric current pulse that the detonator needed to function. Such foils were constructed to have resistances of no more than a few milliohms and inductances of no more than a few nanohenrys. The electric pulses used typically had a peak amplitude of 2–4 kiloamps over a few tenths of a microsecond, and depends on the geometry and material composition of the detonator and its thin conductive foil.

Conventional slapper detonator systems are fundamentally safe and reliable. But such systems do not lend themselves well to automated and mass-production methods. So conventional slapper detonator systems are often too bulky, too heavy, and too costly to manufacture. Modern applications require no less reliable detonator systems, but now demand lower weight, reduced cost, and smaller sizes than are now available.

Nano-engineered multilayer materials are characterized by a near-atomic scale and have large interfacial area to volume ratios. Multilayer materials are well known materials for scientific study and physics applications. Their use has been demonstrated at many laboratories, including LLNL where multiayers are a core technology supporting many programmatic and scientific activities. In the recent past, high-quality dielectric materials have been developed for capacitors with an order of magnitude increase in their energy densities over conventional technology. The fabrication of dielectrics and conductors by multilayer synthesis technologies allows generic processes to be used to deposit a wide range of thin film materials.

Metal oxide dielectrics with a maximum standoff field of 4 MV/cm have been demonstrated in actual capacitors. Enhanced performance can be expected if materials with higher dielectric constants are employed. Such structures are also thermally and mechanically robust with strengths approaching the theoretical limits of the component materials. Metal-to-metal multilayers have been experimentally demonstrated for several alloys and are observed to be stable in multilayer form to temperatures in excess of 500° C. Materials selection, design of the synthesis process, and materials processing can all be manipulated for further improvements.

Slapper detonators universally comprise an energy storage capacitor, a vacuum breakdown switch, an exploding bridgefoil and a flier. New applications require miniaturization and lower costs. Conventional capacitors are simply too large. Gaseous type switches are both too large and too expensive. Conventional capacitors, switches, bridgefoils, and triggering components are very labor intensive, they all must be hand-assembled. The result is packages that are bulky and that need long transmission lines to feed current to the bridgefoil assembly.

Conventional munitions and commercial explosives never have been able to incorporate slapper detonators due to size, weight, and cost constraints.

SUMMARY OF THE INVENTION

An object of the present invention is to provide a slapper detonator that is safe, reliable and inexpensive to manufacture.

A further object of the present invention is to provide a slapper detonator that is microminiaturized.

Briefly, a slapper detonator of the present invention comprises a solid-state high-voltage capacitor, a low-jitter dielectric breakdown switch and trigger circuitry, a detonator transmission line, an exploding foil bridge, and a flier material. All these components are fabricated in a single solid-state device using thin film deposition techniques.

An advantage of the present invention is a slapper detonator is provided that is safe, reliable and inexpensive to manufacture.

Another advantage of the present invention is that a microminiaturized slapper detonator is provided that is very small and that consumes very little volume.

DETAILED DESCRIPTION OF THE INVENTION

Figure 1A:
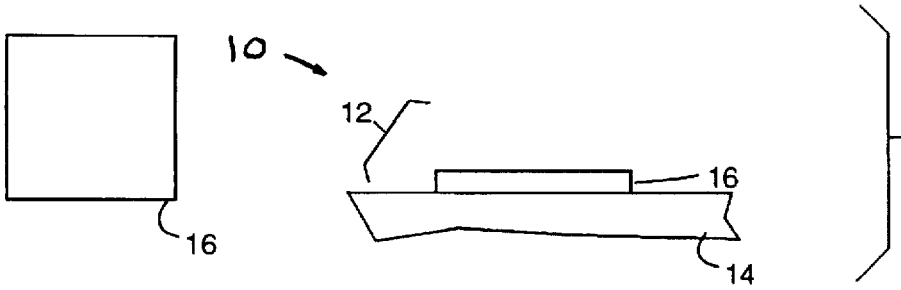
FIGS. 1A–1D are plan views and corresponding cross-sectional views for the first few depositions of a metal-dielectric-metal multilayer capacitor in a fireset embodiment of the present invention.

FIGS. 1A–1D, 2–D and 3A–3D collectively illustrate the fabrication of a planar solid state fireset in a method embodiment of the present invention, referred to herein by the general reference numeral 10. The vertical dimension is exaggerated in order to better show the individual layers after deposit. The step coverage, e.g., the filling in of sidewalls, has been ignored, but does in fact occur. Such sidewall step coverage is depended upon to connect various metal layers together, especially along the vertical walls, to complete the appropriate circuits.

FIGS. 1A–1D illustrate the fabrication of a nanostructure multilayer capacitor 12 on a substrate 14. U.S. Pat. Nos. 5,414,588 and 5,486,277, issued to Troy W. Barbee, Jr., describe nanostructure multilayer capacitors and methods for making them, and are incorporated herein by reference. Such is used herein to form high energy density capacitors.

The fabrication of the structures described herein can be simplified by the use of a stepped-mask deposition system. U.S. patent application, Ser. No. 08/674,051, filed Jul. 7, 1996 by the present Assignee, is incorporated herein by reference. Such Application describes a method and apparatus for making depositions in a vacuum, and is generally suitable for nanostructure fabrication of the fireset 10. In summary, the method for fabricating parts this way includes manipulating the lateral position of a mask with an aperture stationed between a vacuum deposition source and a substrate. Then, positioning the mask to one side at a first position while depositing a first metal for a first electrode. And, moving the mask to center at a second position and depositing a dielectric layer askew of the previous metal layer for the first electrode. The mask is then moved to the opposite side to a third position, wherein a second metal for a second electrode is deposited askew of the dielectric deposition and further askew of the first electrode metal deposition. The first, second, third and second positions are revisited and more of the first electrode metal, the dielectric, the second electrode metal and the dielectric are deposited. The adjacent layers of the first electrode metal are all connected together along an edge that the dielectric is skewed away from, and the adjacent layers of the second electrode metal are all connected together on an opposite side along an edge that the dielectric is skewed away from them. The mask is shuttled back and forth with the appropriate depositions being made until a stack with a number of layers has been fabricated.

Figure 1B:
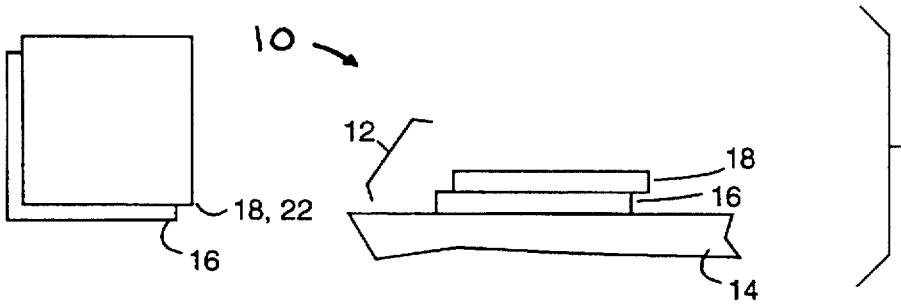
Figure 1C:
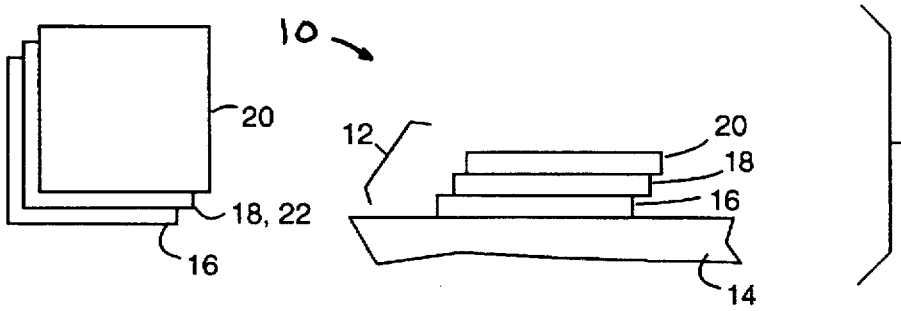
Figure 1D:
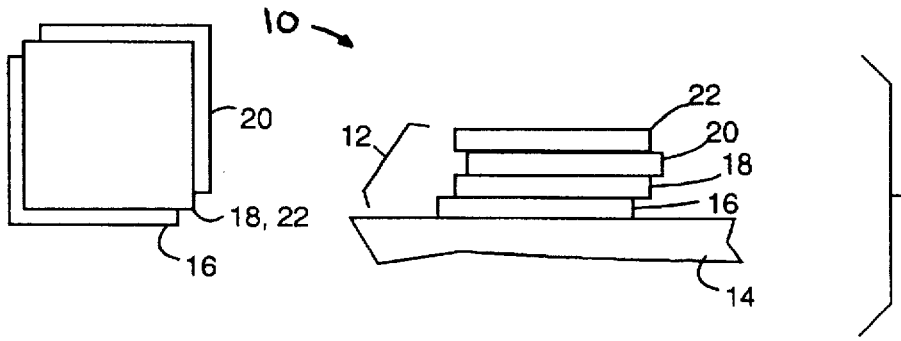

In FIG. 1A, a metal deposition 16 is laid down on the substrate 14. In FIG. 1B, a dielectric material 18 is deposited on top of and askew of the metal deposition 16, e.g., to reveal at least one edge of the metal deposition 16 that can be used for electrical connection into a first circuit by later metal depositions. In FIG. 1C, a metal 20 is deposited on top of and askew of the dielectric material 18, e.g., to avoid connecting to the revealed edge of the metal deposition 16, and also providing for the electrical connection to a second circuit by later metal depositions. In FIG. 1D, a dielectric material 22 is deposited on top of and askew of the metal deposition 20, e.g., directly over the first dielectric 18. Further depositions of metal and dielectric can be used to build up a multiplate capacitor where higher capacitor values are needed. For example, standard semiconductor processing techniques can be used, wherein the deposited metal is aluminum and the deposited dielectric is silicon dioxide.

Figure 2A:
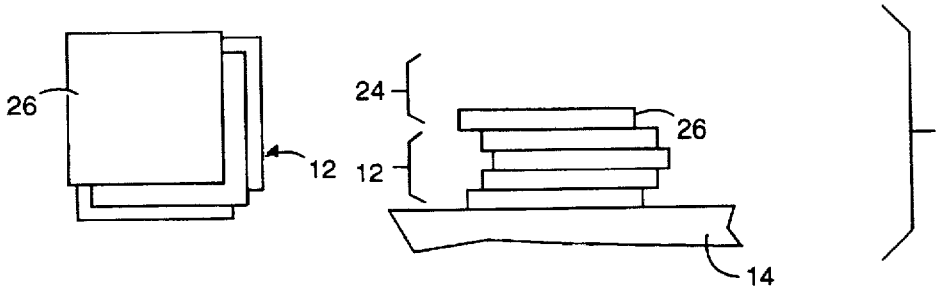
FIGS. 2A–2D are plan views and corresponding cross-sectional views for the depositions required to form a dielectric switch on top of the metal-dielectric-metal multilayer capacitor of FIGS. 1A–1D.
Figure 2B:
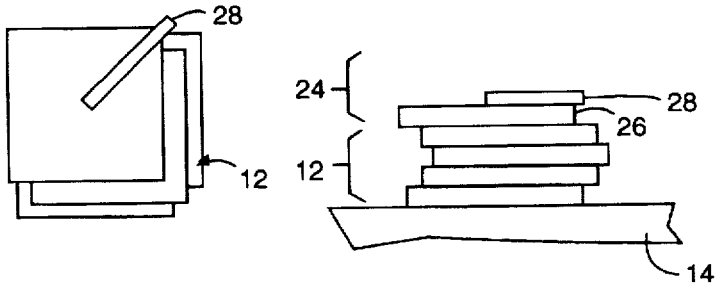
Figure 2C:
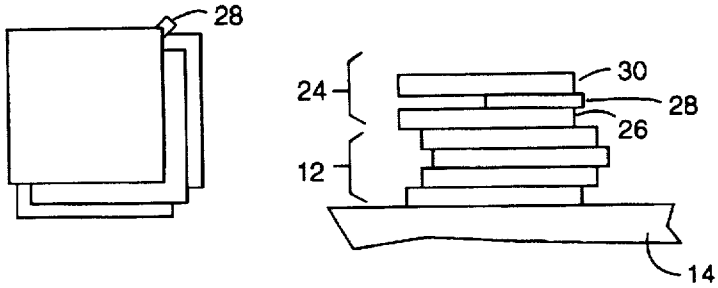
Figure 2D:
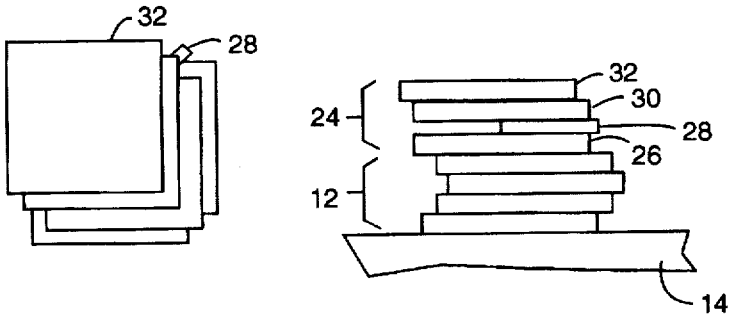

In FIGS. 2A–2D a dielectric switch 24 is fabricated on top of the capacitor 12. The topmost metal deposition of the capacitor 12, e.g., metal deposition 20, also serves as the bottom main plate of the switch 24. In FIG. 2A, a dielectric layer 26 is added on top of and askew of the dielectric layer 22. In FIG. 2B, a metal switch trigger electrode 28 is laid down across the dielectric layer 26. In FIG. 2C, another dielectric layer 30 is added directly on top of the dielectric layer 28 and covers the active area of the metal switch trigger electrode 28. In FIG. 2D, a top main plate is laid down as a metal deposition 32 on top of the dielectric layer 30. The dielectric switch 24 operates by inducing a catastrophic punch-through of current between the top and bottom main plates (layers 20 and 32) by pulsing the trigger electrode 28 to overstress the dielectric layers 22, 26 and 30. Such switch 24 is useful for only one off-to-on cycle.

Figure 3A:
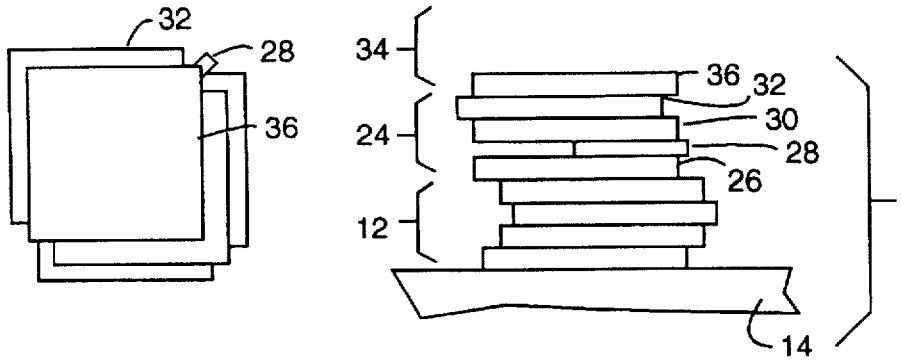
FIGS. 3A–3D are plan views and corresponding cross-sectional views for the depositions required to fabricate a slapper detonator on top of the dielectric switch of FIGS. 2A–2D, and FIG. 3D includes a schematic representation of a trigger transformer, bleed down resistor and two high-voltage sources as they would be connected to the whole.
Figure 3B:
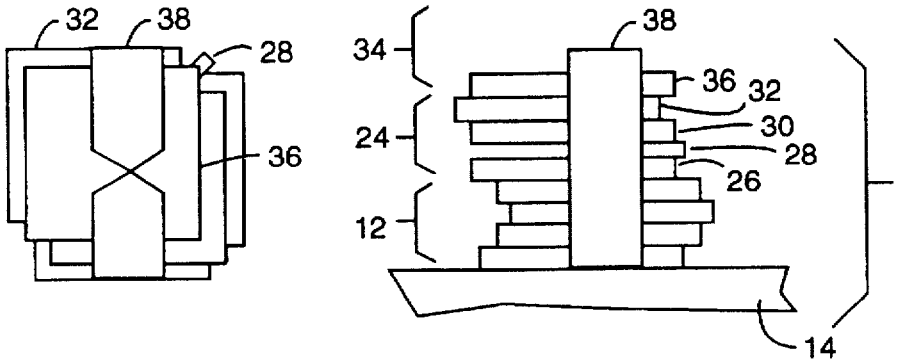
Figure 3C:
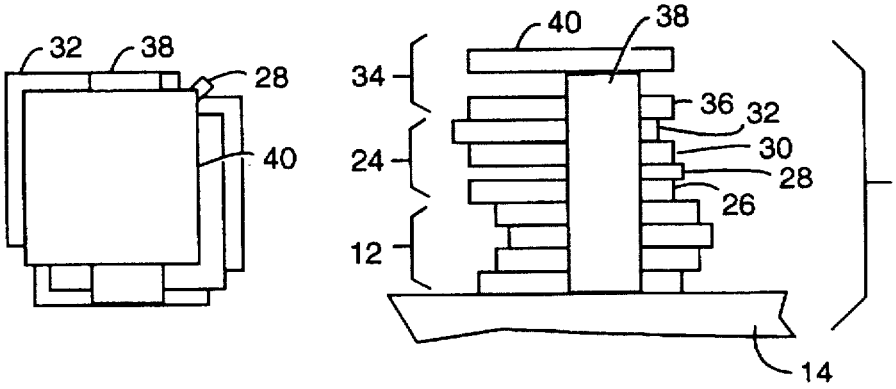
Figure 3D:
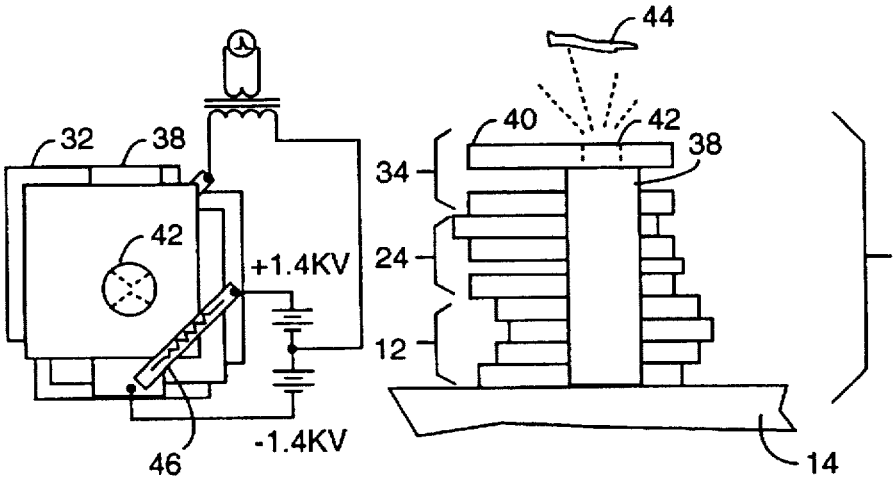

In FIGS. 3A–3D a slapper detonator 34 is fabricated on top of the switch 24. A dielectric layer 36 is laid down for insulation and a bridgefoil 38 is patterned of metal to have a necked-down portion in the center and legs that extend down on opposite sides to connect between the switch 24, especially metal layer 32, and metal layer 16 of capacitor 12. A dielectric flier material layer 40, e.g., a polymer such as MYLAR or other material compatible with nanostructure multilayer deposition methods, is laid down for insulation and a barrel 42 is opened up in the layer 40 to expose the flier material layer 40 in the area of the necked-down portion of the bridgefoil layer 38. A fragment 44, in FIG. 3D, represents a flier material ejection that is intended to strike a sensitive high explosive in its armed-fireset position. A resistor 46 is shown connected to bleed-down lingering charges on the capacitor 12, e.g., to improve safety. The fireset 10 and such sensitive high explosive together are equivalent to a blasting cap.

As in conventional assemblies, when the fireset 10 is not in its armed state, the fragment 44 must critically be prevented from finding and striking the sensitive high explosive. Such can be done by tucking the sensitive high explosive away in a protective tube until the fireset is armed. The moving of the sensitive high explosive into position can be accomplished with a piezoelectric motor. The chemistries and the physics of the flier material 40 and a high explosive are preferably selected such that the striking of a high explosive by the flier material fragment 44 cannot cause a detonation.

Figure 4:
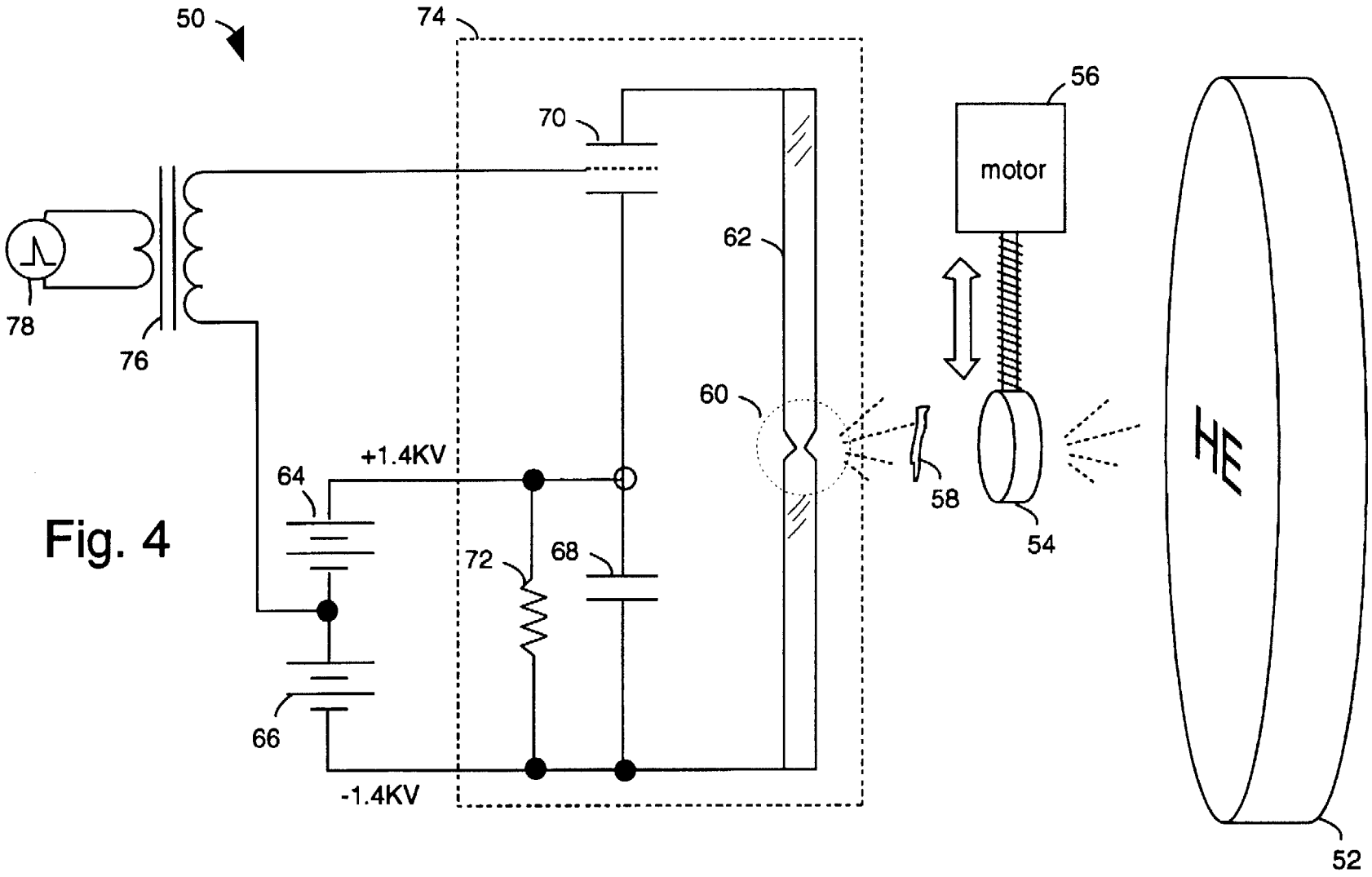
FIG. 4 is a schematic diagram of a slapper detonator system embodiment of the present invention that includes the fireset represented by FIGS. 1A–1D, 2A–2D, and 3A–3D.

FIG. 4 illustrates an explosives system 50, which is an embodiment of the present invention. A high explosive 54 is positioned next to a sensitive high explosives pellet 52 for detonation, and is similar in function to a blasting cap arrangement. A motor 56 is able to position the pellet 54 inline to be struck by a high velocity fragment 58. The motor used can be an ordinary induction motor, a stepper motor, a piezoelectric motor, etc. Such fragment 58 may comprise a polymer film, e.g., MYLAR, that is launched through a barrel 60 when a bridgefoil 62 is electrically vaporized. A pair of energy sources 64 and 66 provide the electrical power necessary to make the bridgefoil blow like an overloaded fuse. Such power sources 64 and 66 may include laser beams connected to photovoltaic cells through fiber optic cables, chemical batteries, piezoelectric stacks, etc. A capacitor 68 is charged to a minimum operating potential, e.g., 3 KV, and has a source impedance low enough to deliver a current pulse to the bridgefoil 62 that can exceed one hundred amperes when a dielectric switch 70 is triggered to close. A bleed-down resistor 72 dissipates any charge that may have been acquired by the capacitor 68 if the switch 70 is not dosed shortly after receiving an input from the power sources 64 and 66. A fireset 74 which includes barrel 60, bridgefoil 62, capacitor 68, switch 70 and resistor 72, is formed and is similar to fireset 10 of FIGS. 1A–1D, 2A–2D, and 3A–3D. A coupling transformer 76 receives a trigger pulse 78 that has been verified as valid and authentic by external means and applied a voltage spike to the trigger electrode of the dielectric switch 70 that initiates a catastrophic electrical breakdown between the plate electrodes.

Detonator safety is thereby enhanced by requiring three preferably independent initiatives: the application of the energy source, the communication of a trigger pulse, and the moving of the pellet into a position exposed to the flier material fragment. If any one of these functions is not complete, there while be no detonation.

Such detonator and explosive systems are useful in applications where extreme safety and reliability are required, such as, industrial and mining explosives, escape hatch explosive bolts, space vehicle stage separation, ordnance, etc.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A solid-state fireset, comprising:

a first plurality of dielectric and metal deposition layers on a substrate that are interdigitated and interconnected to form a capacitor;

a second plurality of dielectric and metal deposition layers formed on the first plurality of layers that are interdigitated and interconnected to form a dielectric switch in series with said capacitor; and a third plurality of dielectric and metal deposition layers formed on the second plurality of layers that are interdigitated and interconnected to form a bridgefoil in series with said dielectric switch and said capacitor.

2. The fireset of claim 1, further comprising:

a flier material layer formed on the third plurality of layers; and a layer with a barrel hole over the flier material layer that provides an exit path for a fragment of the flier material to pass through as a result of closing said switch and dumping an electrical charge stored in said capacitor to said bridgefoil.

3. The fireset of claim 1, further comprising:

trigger means connected to said switch for initiating a closure of said switch and a dumping of an electrical charge stored in said capacitor to said bridgefoil.

4. The fireset of claim 1, further comprising:

power source means connected to said capacitor for inputting an electrical charge to be later connected by said switch through to said bridgefoil to initiate a detonation.

5. The fireset of claim 2, further comprising:

a high explosive that provides for detonation when struck by said flier material fragment when positioned near said barrel.

6. The fireset of claim 5, further comprising:

motor means for positioning the high explosive near said barrel to be detonated when struck by said flier material fragment.

* * * * *